US007140844B2

(12) United States Patent
Lee et al.

(10) Patent No.: US 7,140,844 B2
(45) **Date of Patent: *Nov. 28, 2006**

(54) VARIABLE CAPACITY ROTARY COMPRESSOR

(75) Inventors: In Ju Lee, Yongin (KR); Sung Hea Cho, Suwon (KR); Seung Kap Lee, Suwon (KR); Cheol Woo Kim, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 180 days.

This patent is subject to a terminal disclaimer.

(21) Appl. No.: 10/829,421

(22) Filed: Apr. 22, 2004

(65) Prior Publication Data

US 2005/0019191 A1 Jan. 27, 2005

(30) Foreign Application Priority Data

Jul. 23, 2003 (KR) ..... 10-2003-0050690

(51) Int. Cl.
*F04B 49/00* (2006.01)

(52) U.S. Cl. ..... 417/218; 417/221; 417/223; 417/287; 417/410.3; 418/29; 418/60; 418/69

(58) Field of Classification Search ..... 419/23, 419/29, 60, 69; 417/218, 221, 223, 287, 417/410.3

See application file for complete search history.

(56) References Cited

U.S. PATENT DOCUMENTS

| | | | | |
|---|---|---|---|---|
| 5,871,342 | A | 2/1999 | Harte et al. | |
| 6,086,347 | A * | 7/2000 | Ryska et al. | 418/212 |
| 6,796,773 | B1 * | 9/2004 | Choi et al. | 418/60 |
| 6,910,872 | B1 * | 6/2005 | Cho et al. | 418/60 |

FOREIGN PATENT DOCUMENTS

| | | | | |
|---|---|---|---|---|
| JP | 59063393 | A * | 4/1984 | 417/223 |
| JP | 60125792 | A * | 7/1985 | 418/60 |

* cited by examiner

*Primary Examiner*—Theresa Trieu
(74) *Attorney, Agent, or Firm*—Staas & Halsey LLP

(57) ABSTRACT

A variable capacity rotary compressor including upper and lower compression chambers having different interior capacities, and a rotating shaft. Upper and lower eccentric cams are provided on the rotating shaft to be eccentric from the rotating shaft in a same direction. Upper and lower eccentric bushes are fitted over the upper and lower eccentric cams, respectively, in such a way that a maximum eccentric part of the upper eccentric bush is opposite to that of the lower eccentric bush, with a slot provided between the upper and lower eccentric bushes. A locking pin functions to change a position of the upper or lower eccentric bush to a maximum eccentric position. Further, upper and lower brake units are respectively provided between the upper eccentric cam and the upper eccentric bush, and between the lower eccentric cam and the lower eccentric bush.

31 Claims, 8 Drawing Sheets

VARIABLE CAPACITY ROTARY COMPRESSOR

CROSS-REFERENCE TO RELATED APPLICATION

This application claims the benefit of Korean Application No. 2003-50690, filed Jul. 23, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor, which is designed such that a compression operation is executed in either of two compression chambers having different capacities, by an eccentric unit mounted to a rotating shaft.

2. Description of the Related Art

Generally, a compressor is installed in a refrigeration system, such as an air conditioner and a refrigerator, which operates to cool air in a given space using a refrigeration cycle. In the refrigeration system, the compressor operates to compress a refrigerant which circulates through a refrigeration circuit. A cooling capacity of the refrigeration system is determined according to a compression capacity of the compressor. Thus, when the compressor is designed to vary a compression capacity thereof as desired, the refrigeration system is operated under an optimum condition considering several factors, such as a difference between a practical temperature and a predetermined temperature, thus allowing air in a given space to be efficiently cooled, and saving energy.

A variety of compressors are used in the refrigeration systems. The compressors are typically classified into two types-i.e., rotary compressors and reciprocating compressors. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be rotated over the eccentric cam.

The rotary compressor constructed as described above is operated as follows. As the rotating shaft rotates, the eccentric cam and the roller execute eccentric rotation in the compression chamber. At the time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor which is constructed so that a compression operation is executed in either of two compression chambers having different capacities by an eccentric unit mounted to a rotating shaft, thus varying a compression capacity as desired.

It is other aspect of the present invention to provide a variable capacity rotary compressor, which is designed to prevent an eccentric bush from being rotated faster than a rotating shaft in a specific range, due to a variance in pressure of a compression chamber as the rotating shaft is rotated.

Additional and/or other aspects and advantages of the invention will be set forth in part in the description which follows and, in part, will be obvious from the description, or may be learned by practice of the invention.

The above and/or other aspects are achieved by providing a variable capacity rotary compressor including upper and lower compression chambers, a rotating shaft, upper and lower eccentric cams, upper and lower eccentric bushes, a slot, a locking pin, an upper brake unit, and a lower brake unit. The upper and lower compression chambers have different interior capacities. The rotating shaft passes through the upper and lower compression chambers. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin functions to change a position of the upper or lower eccentric bush to a maximum eccentric position, in cooperation with the slot. The upper brake unit functions to prevent the upper eccentric bush from slipping over the rotating shaft, and the lower brake unit functions to prevent the lower eccentric bush from slipping over the rotating shaft.

According to an aspect of the invention, the locking pin is projected from the rotating shaft at a position between the upper and lower eccentric cams, the slot is provided between the upper and lower eccentric bushes to engage with the locking pin, the upper brake unit is provided between the upper eccentric cam and the upper eccentric bush, and the lower brake unit is provided between the lower eccentric cam and the lower eccentric bush.

According to an aspect of the invention, the upper brake unit includes an upper pocket formed on an outer surface of the upper eccentric cam, an upper brake ball movably set in the upper pocket, and an upper brake hole formed on an inner surface of the upper eccentric bush to have a smaller diameter than the upper brake ball, so that, when the locking pin contacts a first end of the slot, the upper pocket is aligned with the upper brake hole and the upper brake ball is inserted into the upper brake hole due to a centrifugal force.

According to an aspect of the invention, the lower brake unit includes a lower pocket formed on an outer surface of the lower eccentric cam, a lower brake ball movably set in the lower pocket, and a lower brake hole formed on an inner surface of the lower eccentric bush to have a smaller diameter than the lower brake ball, so that, when the locking pin contacts a second end of the slot, the lower pocket is aligned with the lower brake hole and the lower brake ball is inserted into the lower brake hole due to a centrifugal force.

According to an aspect of the invention, the slot has a length to allow an angle between a first line extending from the first end of the slot to a center of the rotating shaft and a second line extending from a second end of the slot to the center of the rotating shaft, to be 180°, the upper pocket and the upper brake hole are positioned to be aligned with each other when the locking pin contacts the first end of the slot, and the lower pocket and the lower brake hole are positioned to be aligned with each other when the locking pin contacts the second end of the slot.

According to an aspect of the invention, an oil passage is axially provided along the rotating shaft, the upper pocket communicates with the oil passage via an upper connecting passage having a smaller diameter than the upper brake ball, and the lower pocket communicates with the oil passage via a lower connecting passage having a smaller diameter than the lower brake ball, so that oil is fed from the oil passage through the upper and lower connecting passages to the upper and lower pockets, thus allowing an oil pressure to act on the upper and lower brake balls in a radial direction of the rotating shaft.

According to an aspect of the invention, the upper and lower brake holes are respectively formed through the upper and lower eccentric bushes in a radial direction, thus allowing the oil to flow to outsides of the upper and lower eccentric bushes after passing through the oil passage and the upper and lower brake holes.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
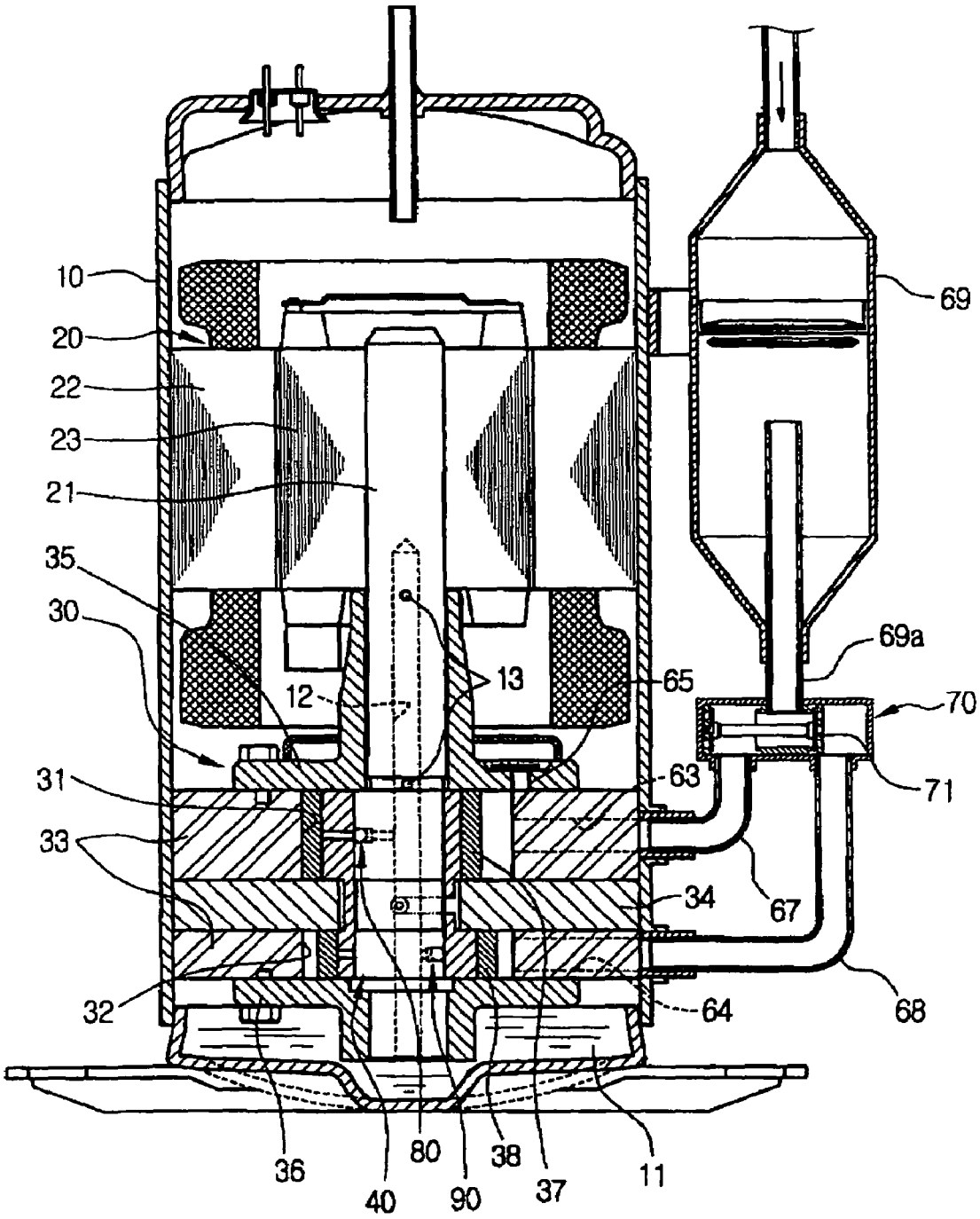
FIG. 1 is a sectional view showing an interior construction of a variable capacity rotary compressor, according to an embodiment of the present invention.

Reference will now be made in detail to embodiments of the present invention, examples of which are illustrated in the accompanying drawings, wherein like reference numerals refer to like elements throughout.

FIG. 1 is a sectional view showing a variable capacity rotary compressor, according to an embodiment of the present invention. As illustrated in FIG. 1, the variable capacity rotary compressor includes a hermetic casing 10. A drive unit 20 and a compressing unit 30 are installed in the hermetic casing 10. The drive unit 20 generates a rotating force, and the compressing unit 30 compresses gas using the rotating force of the drive unit 20. The drive unit 20 includes a cylindrical stator 22, a rotor 23, and a rotating shaft 21. The stator 22 is fixedly mounted to an inner surface of the hermetic casing 10. The rotor 23 is rotatably installed in the stator 22. The rotating shaft 21 is installed to pass through a center of the rotor 23, and is rotated along with the rotor 23 in a first direction which is counterclockwise in the drawings or in a second direction which is clockwise in the drawings.

The compressing unit 30 includes a housing 33, upper and lower flanges 35 and 36, and a partition plate 34. The housing 33 defines upper and lower compression chambers 31 and 32, which are both cylindrical but have different capacities, therein. The upper and lower flanges 35 and 36 are mounted to upper and lower ends of the housing 33, respectively, to rotatably support the rotating shaft 21. The partition plate 34 is interposed between the upper and lower compression chambers 31 and 32 to partition the upper and lower compression chambers 31 and 32 from each other.

The shown upper compression chamber 31 is taller than the lower compression chamber 32. Thus, the upper compression chamber 31 has a larger capacity than the lower compression chamber 32. Therefore, a larger amount of gas is compressed in the upper compression chamber 31 in comparison with the lower compression chamber 32, thus allowing the rotary compressor to have a variable capacity.

Similarly, it is understood according to another aspect of the invention, if the lower compression chamber 32 is taller than the upper compression chamber 31, the lower compression chamber 32 has a larger capacity than the upper compression chamber 31, thus allowing a larger amount of gas to be compressed in the lower compression chamber 32. However, it is understood that the chambers 31, 32 need not have different capacities in all aspects of the invention.

Further, an eccentric unit 40 is placed in the upper and lower compression chambers 31 and 32 to execute a compressing operation in either the upper or lower compression chamber 31 and 32, according to a rotating direction of the rotating shaft 21. Upper and lower brake units 80 and 90 are provided at predetermined positions of the eccentric unit 40 to smoothly operate the eccentric unit 40. The construction and operation of the eccentric unit 40 and the upper and lower brake units 80 and 90 will be described later herein, with reference to FIGS. 2 to 8.

Upper and lower rollers 37 and 38 are placed in the upper and lower compression chambers 31, respectively, to be rotatably fitted over the eccentric unit 40. Upper inlet and outlet ports 63 and 65 (see, FIG. 3) are formed at predetermined positions of the housing 33 to communicate with the upper compression chamber 31. Lower inlet and outlet ports 64 and 66 (see, FIG. 6) are formed at predetermined positions of the housing 33 to communicate with the lower compression chamber 32.

Figure 3:
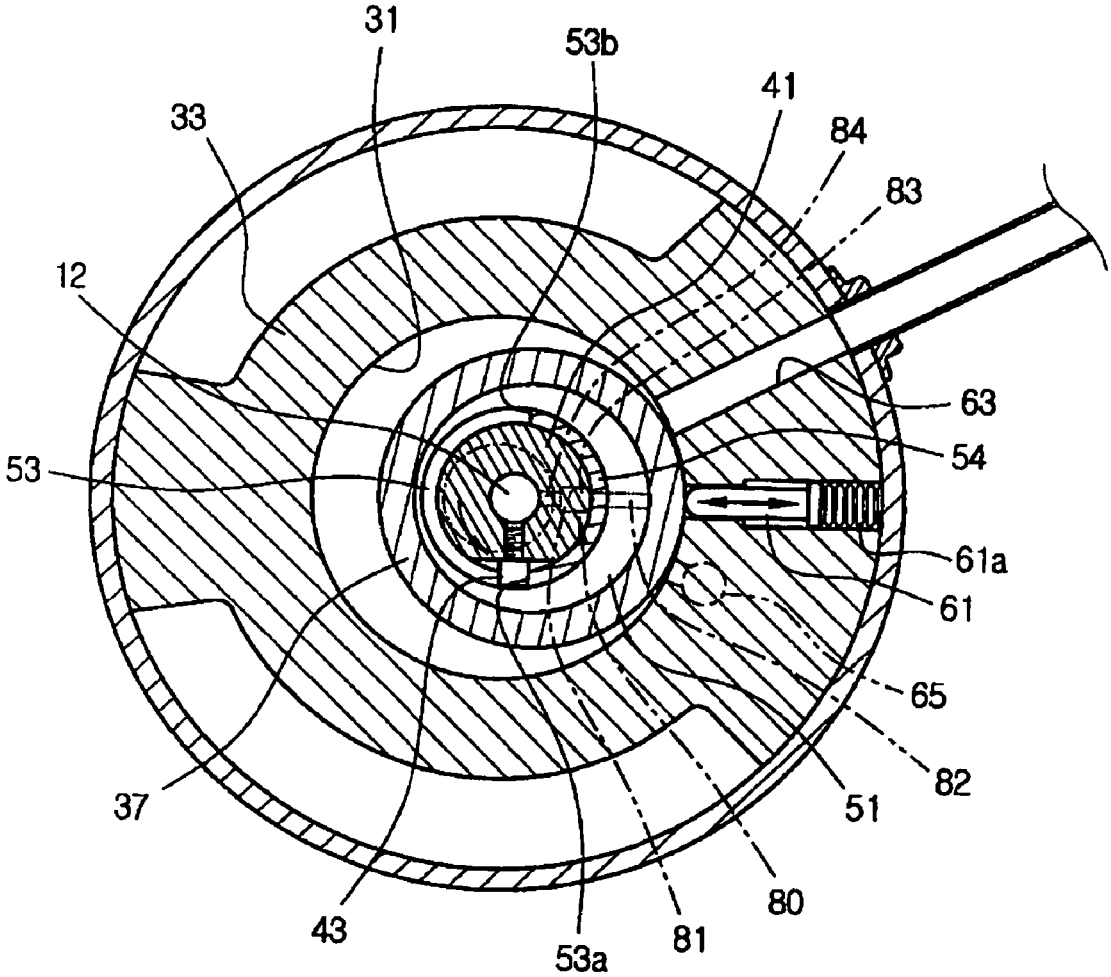
FIG. 3 is a sectional view showing an upper compression chamber where a compression operation is executed without slippage by the eccentric unit of FIG. 2, when the rotating shaft is rotated in a first direction.

An upper vane 61 is positioned between the upper inlet and outlet ports 63 and 65, and is biased in a radial direction by an upper support spring 61*a* to be in close contact with the upper roller 37 (see, FIG. 3). Further, a lower vane 62 is positioned between the lower inlet and outlet ports 64 and 66, and is biased in a radial direction by a lower support spring 62*a* to be in close contact with the lower roller 38 (see, FIG. 6).

Further, a refrigerant outlet pipe 69*a* extends from an accumulator 69 which contains a refrigerant therein. Of the refrigerant contained in the accumulator 69, only a gas refrigerant flows into the compressor through the refrigerant outlet pipe 69*a*. At a predetermined position of the refrigerant outlet pipe 69*a* is installed a path control unit 70. The path control unit 70 functions to open or close an intake path 67 or 68, thus supplying the gas refrigerant to the upper or lower inlet port 63 or 64 of the upper or lower compression chamber 31 or 32 in which a compression operation is executed. A valve unit 71 is installed in the path control unit 70 to be movable in a horizontal direction. The valve unit 71 functions to open either the intake paths 67 or 68 by a difference in pressure between the intake path 67 connected to the upper inlet port 63 and the intake path 68 connected to the lower inlet port 64, thus supplying the gas refrigerant to the upper inlet port 63 or lower inlet port 64.

Further, a predetermined amount of oil 11 is contained in a lower portion of the hermetic casing 10 to lubricate and cool several contact parts of the compressing part 30. An oil passage 12 is axially formed along the rotating shaft 21 to be eccentric from a central axis C1—C1 of the rotating shaft 21, and functions to move the oil 11 upward by a centrifugal force resulting from a rotation of the rotating shaft 21. A plurality of oil supply holes 13 are formed on the rotating shaft 21 in radial directions to communicate with the oil passage 12, thus supplying the oil 11, which flows upward through the oil passage 12, to the contact parts.

The construction of the rotating shaft and the eccentric unit according to an embodiment of the present invention will be described in the following with reference to FIG. 2.

Figure 2:
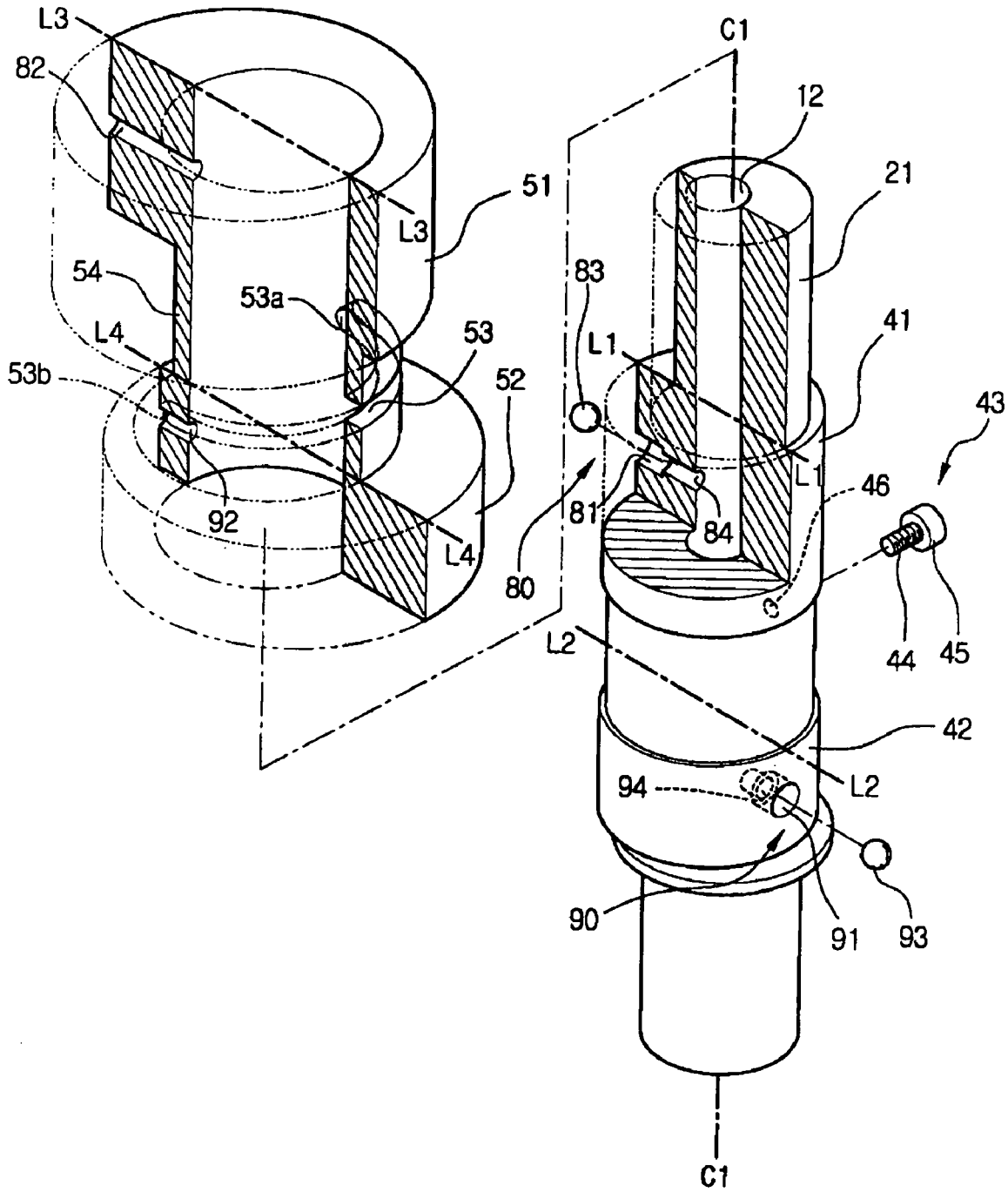
FIG. 2 is an exploded perspective view of an eccentric unit included in the compressor of FIG. 1, in which upper and lower eccentric bushes of the eccentric unit are separated from a rotating shaft.

FIG. 2 is an exploded perspective view of the eccentric unit included in the compressor of FIG. 1, in which upper and lower eccentric bushes 51, 52 of the eccentric unit 40 are separated from the rotating shaft 21. As illustrated in the drawing, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. Upper and lower eccentric bushes 51 and 52 are fitted over the upper and lower eccentric cams 41 and 42, respectively. A locking pin 43 is provided at a predetermined position between the upper and lower eccentric cams 41 and 42. A slot 53 of a predetermined length is provided at a predetermined position between the upper and lower eccentric bushes 51 and 52 to engage with the locking pin 43. The eccentric unit 40 also includes the upper and lower brake units 80 and 90. The upper and lower brake units 80 and 90 function to prevent either the upper or lower eccentric bush 51 or 52 from slipping over the upper or lower eccentric cam 41 or 42 at a predetermined position.

The upper and lower eccentric cams 41 and 42 are integrally fitted over the rotating shaft 21 to be eccentric from the central axis C1—C1 of the rotating shaft 21. The upper and lower eccentric cams 41 and 42 are positioned to correspond an upper eccentric line L1—L1 of the upper eccentric cam 41 to a lower eccentric line L2—L2 of the lower eccentric cam 42. In this case, the upper eccentric line L1—L1 is defined as a line to connect a maximum eccentric part of the upper eccentric cam 41, which is maximally projected from the rotating shaft 21, to a minimum eccentric part of the upper eccentric cam 41, which is minimally projected from the rotating shaft 21. Meanwhile, the lower eccentric line L2—L2 is defined as a line to connect a maximum eccentric part of the lower eccentric cam 42, which is maximally projected from the rotating shaft 21, to a minimum eccentric part of the lower eccentric cam 42, which is minimally projected from the rotating shaft 21.

The locking pin 43 includes a threaded shank 44 and a head 45. The head 45 has slightly larger diameter than the shank 44, and is formed at an end of the shank 44. Further, a threaded hole 46 is formed on the rotating shaft 21 between the upper and lower eccentric cams 41 and 42 to be at about 90° with the maximum eccentric parts of the upper and lower eccentric cams 41 and 42. The threaded shank 44 of the locking pin 43 is inserted into the threaded hole 46 in a screw-type fastening method to lock the locking pin 43 to the rotating shaft 21.

The upper and lower eccentric bushes 51 and 52 are integrated with each other by a connecting part 54. The connecting part 54 connects the upper and lower eccentric bushes 51 and 52 to each other. The slot 53 is formed around a part of the connecting part 54, and has a width, which is slightly larger width than a diameter of the head 45 of the locking pin 43. Thus, when the upper and lower eccentric bushes 51 and 52 which are integrally connected to each other by the connecting part 54 are fitted over the rotating shaft 21 and the locking pin 43 is inserted to the threaded hole 46 of the rotating shaft 21 through the slot 53, the locking pin 43 is mounted to the rotating shaft 21 while engaging with the slot 53.

When the rotating shaft 21 is rotated in the first or second direction in such a state, the upper and lower eccentric bushes 51 and 52 are not rotated until the locking pin 43 comes into contact with one of the first and second ends 53*a* and 53*b* of the slot 53. When the locking pin 43 comes into contact with the first or second end 53*a* or 53*b* of the slot 53, the upper and lower eccentric bushes 51 and 52 are rotated in the first or second direction along with the rotating shaft 21.

In this case, an eccentric line L3—L3, which connects the maximum eccentric part of the upper eccentric bush 51 to the minimum eccentric part thereof, is placed at about 90° with a line which connects the first end 53*a* of the slot 53 to a center of the connecting part 54. Meanwhile, an eccentric line L4—L4, which connects the maximum eccentric part of the lower eccentric bush 52 to the minimum eccentric part thereof, is placed at about 90° with a line which connects the second end 53*b* of the slot 53 to the center of the connecting part 54.

Further, the eccentric line L3—L3 of the upper eccentric bush 51 and the eccentric line L4—L4 of the lower eccentric bush 52 are positioned on a same plane, but the maximum eccentric part of the upper eccentric bush 51 is arranged to be opposite to the maximum eccentric part of the lower eccentric bush 52. An angle between a line extending from the first end 53*a* of the slot 53 to a center of the rotating shaft 21 and a line extending from the second end 53*b* of the slot 53 to the center of the rotating shaft 21 is 180°. The slot 53 is formed around a part of the connecting part 54.

In the eccentric unit 40 constructed as described above, the upper brake unit 80 is provided between the upper eccentric cam 41 and the upper eccentric bush 51, while the lower brake unit 90 is provided between the lower eccentric cam 42 and the lower eccentric bush 52. The upper brake unit 80 includes an upper pocket 81, an upper brake hole 82, and an upper brake ball 83. The upper pocket 81 is bored on an outer surface of the upper eccentric cam 41 to have a predetermined diameter. The upper brake hole 82 is bored on an inner surface of the upper eccentric bush 51 to have a predetermined diameter. The upper brake ball 83 is set in the upper pocket 81.

The upper brake ball 83 has a slightly smaller diameter than the upper pocket 81 while having a slightly larger diameter than the upper brake hole 82. Thus, the upper brake ball 83 is movably set in the upper pocket 81. When the centrifugal force is generated in such a state, the upper brake ball 83 moves outward to be inserted into the upper brake hole 82, thus preventing the upper eccentric bush 51 from slipping over the upper eccentric cam 41.

The upper pocket 81 is designed to communicate with the oil passage 12 which is axially formed along the rotating shaft 21, via an upper connecting passage 84 which connects the upper pocket 81 to the oil passage 12, to enhance an operational effect of the upper brake ball 83 which prevents the upper eccentric bush 51 from slipping. According to the above-mentioned construction, the oil 11 is supplied from the oil passage 12 through the upper connecting passage 84 to the upper pocket 81. At this time, an oil pressure resulting from the oil 11 acts on the upper brake ball 83 to move the upper brake ball 83 outward. Thus, the upper brake ball 83 comes into closer contact with the upper brake hole 82 of the upper eccentric bush 51, thus effectively preventing the upper eccentric bush 51 from slipping over the upper eccentric cam 41.

Since the upper brake hole 82 is bored from the inner surface of the upper eccentric bush 51 to an outer surface thereof, the oil 11 fed into the upper pocket 81 flows to an outside of the upper eccentric bush 51 through a gap between the upper brake ball 83 and the upper brake hole 82. Such a construction prevents the upper brake ball 83 from being fixed in the upper brake hole 82, by the oil pressure, while allowing a contact part between the upper eccentric bush 51 and the upper roller 37 (see, FIG. 3) fitted over the upper eccentric bush 51 to be lubricated.

When the locking pin 43 contacts the first end 53*a* of the slot 53, and the upper eccentric cam 41 and the upper eccentric bush 51 are positioned to be maximally eccentric from the rotating shaft 21, the upper pocket 81 and the upper brake hole 82 are positioned in a row.

Assuming that the rotating shaft 21 is rotated in the first direction (counterclockwise in FIG. 2), the upper pocket 81 is positioned to lead the locking pin 43 while being angularly spaced apart from the locking pin 43 at an angle of 90°. Further, the upper brake hole 82 is positioned leading the first end 53*a* of the slot 53 while being angularly spaced apart from the first end 53*a* of the slot 53 at an angle of 90°. Thus, when the locking pin 43 contacts the first end 53*a* of the slot 53, and the rotating shaft 21 is rotated along with the upper and lower eccentric bushes 51 and 52 in the first direction, the upper pocket 81 is aligned with the upper brake hole 82 in a row.

The general construction of the lower brake unit 90 remains the same as the upper brake unit 80, except that the lower brake unit 90 is provided between the lower eccentric cam 42 and the lower eccentric bush 52.

The lower brake unit 90 includes a lower pocket 91, a lower brake hole 92, and a lower brake ball 93. The lower pocket 91 is bored on an outer surface of the lower eccentric cam 42. The lower brake hole 92 is bored on an inner surface of the lower eccentric bush 52. The lower brake ball 93 is set in the lower pocket 81.

The lower brake ball 93 has a slightly smaller diameter than the lower pocket 91 while having a slightly larger diameter than the lower brake hole 92. Thus, the lower brake ball 93 is movably set in the lower pocket 91. When the centrifugal force is generated in such a state, the lower brake ball 93 moves outward to be inserted into the lower brake hole 92, thus preventing the lower eccentric bush 52 from slipping over the lower eccentric cam 42.

Further, the lower pocket 91 is designed to communicate with the oil passage 12, which is axially formed along the rotating shaft 21, via a lower connecting passage 94 which connects the lower pocket 91 to the oil passage 12. Thus, oil 11 is supplied from the oil passage 12 through the lower connecting passage 94 to the lower pocket 91. At this time, an oil pressure resulting from the oil 11 acts on the lower brake ball 93 to move the lower brake ball 93 outward. Thus, the lower brake ball 93 comes into closer contact with the lower brake hole 92 of the lower eccentric bush 52, therefore effectively preventing the lower eccentric bush 52 from slipping over the lower eccentric cam 42.

Since the lower brake hole 92 is bored from the inner surface of the lower eccentric bush 52 to an outer surface thereof, the oil 11 fed into the lower pocket 91 flows to an outside of the lower eccentric bush 52 through a gap between the lower brake ball 93 and the lower brake hole 92. Such a construction prevents the lower brake ball 93 from being fixed in the lower brake hole 92, by the oil pressure, while allowing a contact part between the lower eccentric bush 52 and the lower roller 38 (see, FIG. 6) fitted over the lower eccentric bush 52 to be lubricated.

Assuming that the rotating shaft 21 is rotated in the second direction (clockwise in FIG. 2), the lower pocket 91 is positioned to lead the locking pin 43 while being angularly spaced apart from the locking pin 43 at an angle of 90°. Further, the lower brake hole 92 is positioned leading the second end 53*b* of the slot 53 while being angularly spaced apart from the second end 53*b* of the slot 53 at an angle of 90°. Thus, when the locking pin 43 contacts the second end 53*b* of the slot 53, and the rotating shaft 21 is rotated along with the upper and lower eccentric bushes 51 and 52 in the second direction, the lower pocket 91 is aligned with the lower brake hole 92 in a row.

In the compressor constructed in this way, when the locking pin 43 is locked by the first end 53*a* of the slot 53 and the upper eccentric bush 51 is rotated along with the rotating shaft 21 in the first direction (of course, the lower eccentric bush 52 is also rotated), the maximum eccentric part of the upper eccentric bush 51 contacts the maximum eccentric part of the upper eccentric cam 41, so that the upper eccentric bush 51 is rotated in the first direction while being maximally eccentric from the rotating shaft 21 (see, FIG. 3). On the other hand, the maximum eccentric part of the lower eccentric cam 42 contacts the minimum eccentric part of the lower eccentric bush 52, so that the lower eccentric bush 52 is rotated in the first direction while being concentric with the rotating shaft 21 (see, FIG. 4).

At this time, the upper pocket 81 is aligned with the upper brake hole 82 in a row. Thus, the upper brake ball 83 comes into close contact with the upper brake hole 85 by the pressure of the oil 11 fed through the upper connecting passage 84 and the upper pocket 81 and the centrifugal force, so that the upper eccentric bush 51 is rotated while being restrained by the upper eccentric cam 41.

Figure 6:
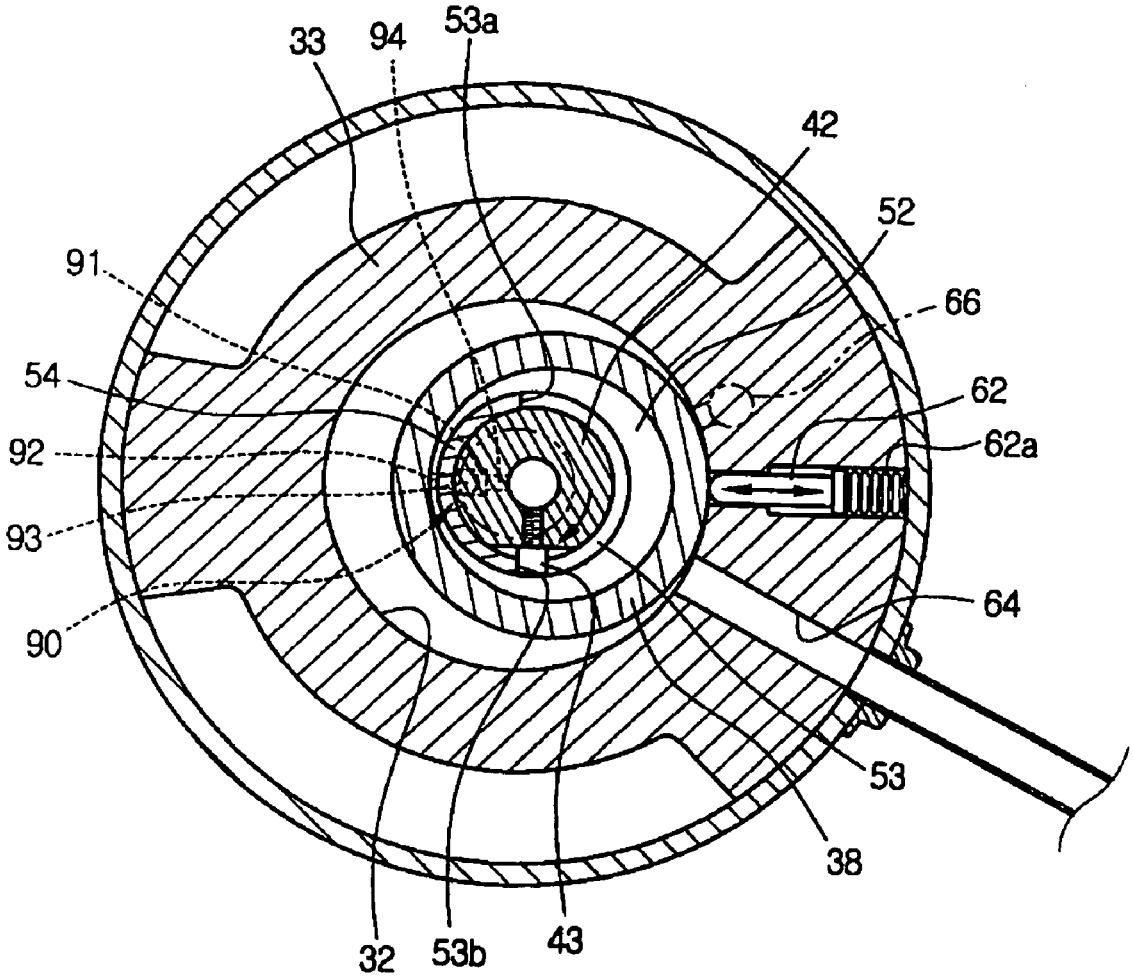
FIG. 6 is a sectional view showing a lower compression chamber where the compression operation is executed without slippage by the eccentric unit of FIG. 2, when the rotating shaft is rotated in a second direction.

Conversely, when the locking pin 43 is locked by the second end 53*b* of the slot 53 and the lower eccentric bush 52 is rotated along with the rotating shaft 21 in the second direction, the maximum eccentric part of the lower eccentric bush 52 contacts the maximum eccentric part of the lower eccentric cam 42, so that the lower eccentric bush 52 is rotated in the second direction while being maximally eccentric from the rotating shaft 21 (see, FIG. 6). On the other hand, the maximum eccentric part of the upper eccentric cam 41 contacts the minimum eccentric part of the upper eccentric bush 51, so that the upper eccentric bush 51 is rotated in the second direction while being concentric with the rotating shaft 21 (see, FIG. 7).

At this time, the lower pocket 91 is aligned with the lower brake hole 92 in a row. The lower brake ball 93 comes into close contact with the lower brake hole 92 by the centrifugal force, so that the lower eccentric cam 42 and the lower eccentric bush 52 are restrained by each other. Further, the oil 11 is fed to the lower pocket 91 through the oil passage 12 and the lower connecting passage 94, thus pushing the lower brake ball 93 outward.

The operation of compressing a gas refrigerant in the upper or lower compression chamber by the eccentric unit according to an embodiment of the present invention will be described in the following with reference to FIGS. 3 to 8.

Figure 4:
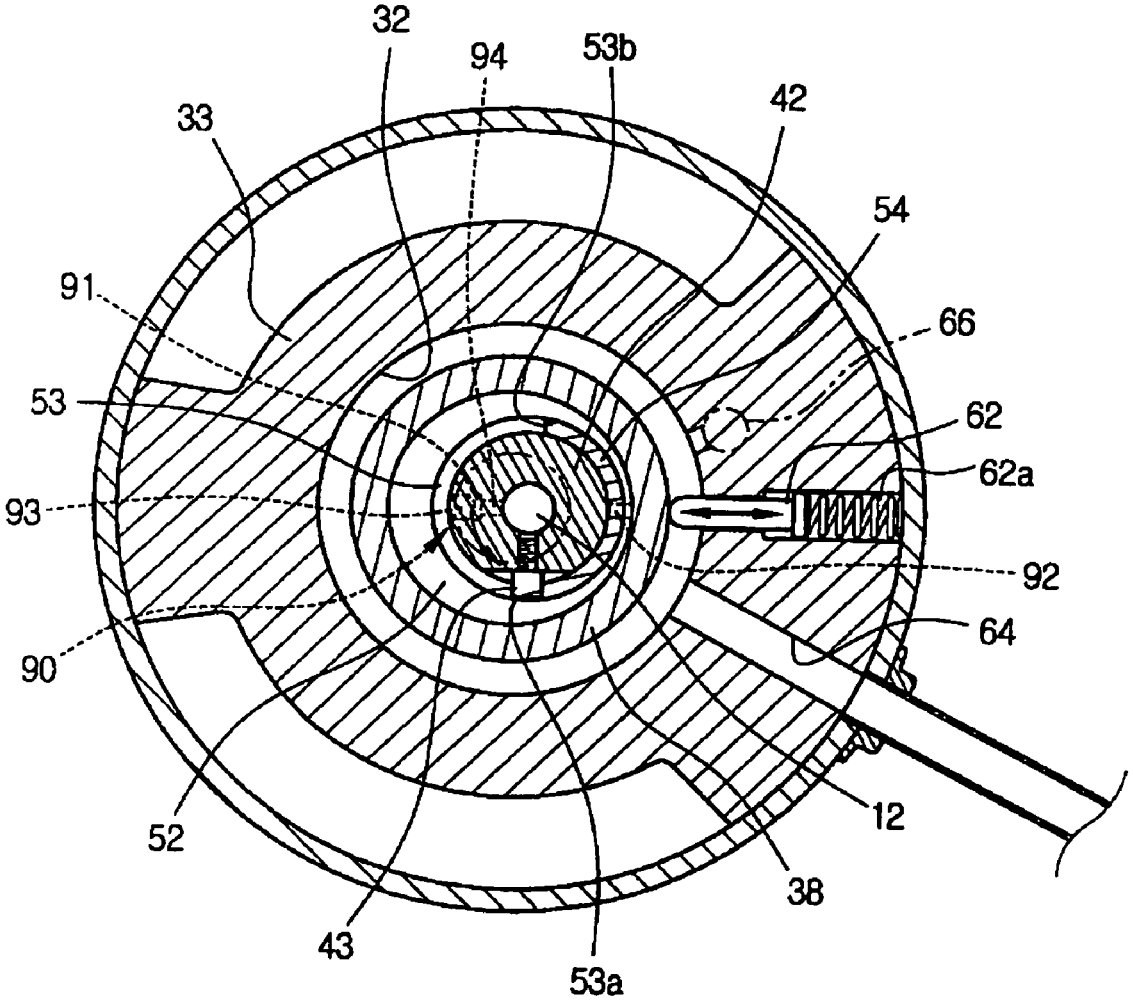
FIG. 4 is a sectional view, corresponding to FIG. 3, which shows a lower compression chamber where an idle operation is executed by the eccentric unit of FIG. 2, when the rotating shaft is rotated in the first direction.
Figure 5:
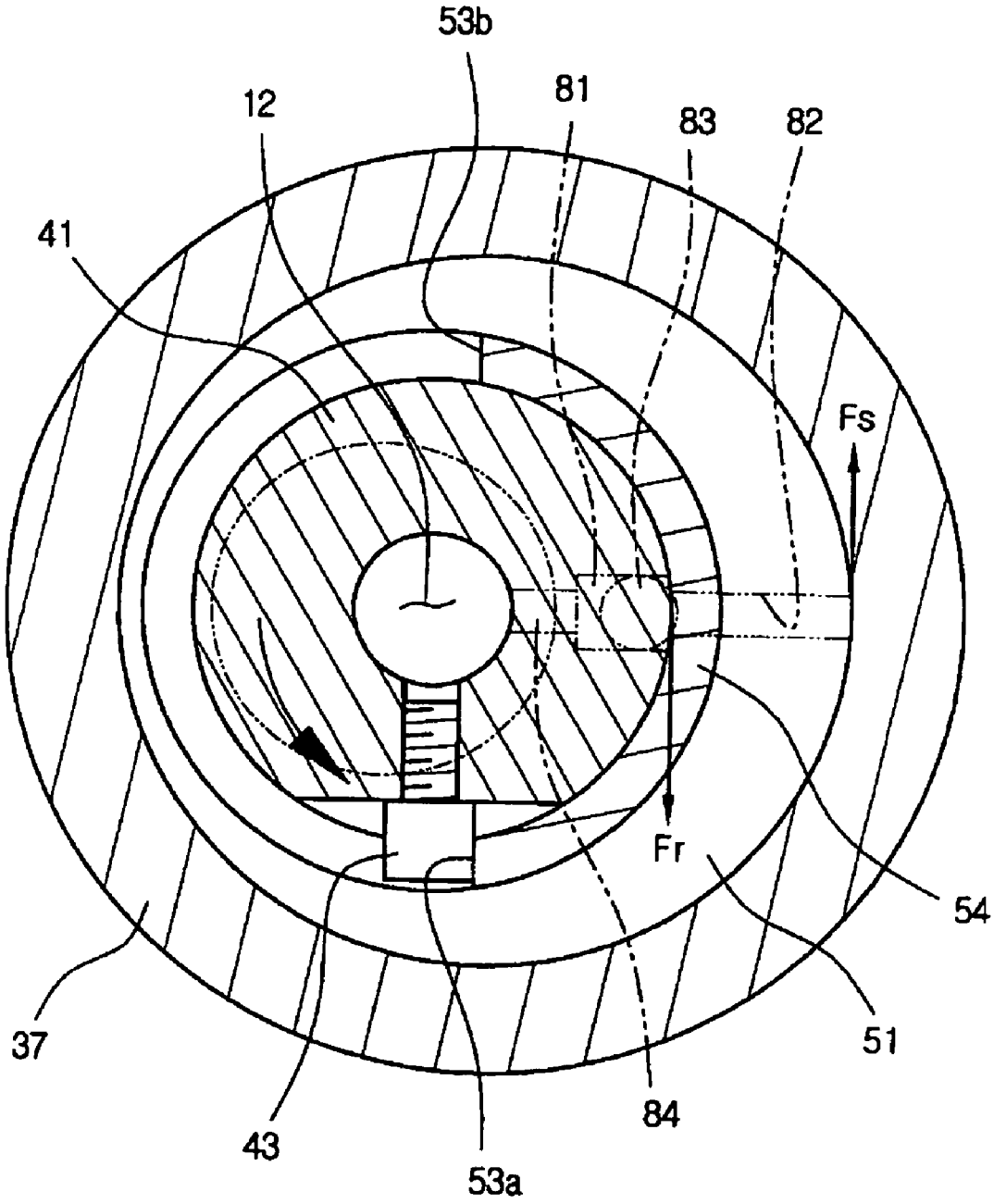
FIG. 5 is a sectional view showing an upper eccentric bush when the rotating shaft is rotated in the first direction, in which the upper eccentric bush does not slip at a predetermined position by the eccentric unit of FIG. 2.

FIG. 3 is a sectional view showing the upper compression chamber 31 where a compression operation is executed without slippage by the eccentric unit 40 of FIG. 2, when the rotating shaft 21 is rotated in a first direction. FIG. 4 is a sectional view, corresponding to FIG. 3, which shows the lower compression chamber 32 where an idle operation is executed by the eccentric unit 46 of FIG. 2, when the rotating shaft 21 is rotated in the first direction. FIG. 5 is a sectional view showing the upper eccentric bush 51 when the rotating shaft 21 is rotated in the first direction, in which the upper eccentric bush 51 does not slip at a predetermined position by the eccentric unit 40 of FIG. 2.

As illustrated in FIG. 3, when the rotating shaft 21 is rotated in the first direction (counterclockwise in FIG. 3), the locking pin 43 projected from the rotating shaft 21 is rotated at a predetermined angle while engaging with the slot 53, which is provided at a predetermined position between the upper and lower eccentric bushes 51 and 52. When the locking pin 43 is rotated at the predetermined angle and is locked by the first end 53*a* of the slot 53, the upper eccentric bush 51 is rotated along with the rotating shaft 21. At this time, since the lower eccentric bush 52 is integrally connected to the upper eccentric bush 51 by the connecting part 54, the lower eccentric bush 52 is also rotated along with the upper eccentric bush 51.

When the locking pin 43 contacts the first end 53*a* of the slot 53, the maximum eccentric part of the upper eccentric cam 41 is aligned with the maximum eccentric part of the upper eccentric bush 51. In this case, the upper eccentric bush 51 is rotated while being maximally eccentric from the central axis C1—C1 of the rotating shaft 21. Thus, the upper roller 37 is rotated while being in contact with an inner surface of the housing 33 to define the upper compression chamber 31, thus executing the compression operation.

Further, the upper pocket 81 of the upper brake unit 80 is aligned with the upper brake hole 82. The upper brake ball 83 comes into close contact with the upper brake hole 82, by the pressure of the oil 11 fed through the oil passage 12 to the upper connecting passage 84 and the centrifugal force, so that the upper eccentric bush 51 is rotated while being restrained by the upper eccentric cam 41.

As illustrated in FIG. 4, the maximum eccentric part of the lower eccentric cam 42 contacts with the minimum eccentric part of the lower eccentric bush 52. In this case, the lower eccentric bush 52 is rotated while being concentric with the central axis C1—C1 of the rotating shaft 21. Thus, the lower roller 38 is rotated while being spaced apart from the inner surface of the housing 33, which defines the lower compression chamber 32, by a predetermined interval, thus the compression operation is not executed.

Therefore, when the rotating shaft 21 is rotated in the first direction, the gas refrigerant flowing to the upper compression chamber 31 through the upper inlet port 63 is compressed by the upper roller 37 in the upper compression chamber 31 having a larger capacity, and subsequently is discharged from the upper compression chamber 31 through the upper outlet port 65. On the other hand, the compression operation is not executed in the lower compression chamber 32 having a smaller capacity. Therefore, the rotary compressor is operated in a larger capacity compression mode.

As shown in FIG. 3, when the upper roller 37 comes into contact with the upper vane 61, the operation of compressing the gas refrigerant is completed and an operation of drawing the gas refrigerant is started. At this time, some of the compressed gas, which was not discharged from the upper compression chamber 31 through the upper outlet port 65, returns to the upper compression chamber 31 and is expanded again, thus applying a pressure to the upper roller 37 and the upper eccentric bush 51 in a rotating direction of the rotating shaft 21. At this time, the upper eccentric bush 51 is rotated faster than the rotating shaft 21, thus causing the upper eccentric bush 51 to slip over the upper eccentric cam 41.

When the rotating shaft 21 is further rotated in such a state, the locking pin 43 collides with the first end 53*a* of the slot 53 to make the upper eccentric bush 51 be rotated at a same speed as that of the rotating shaft 21. At this time, noise may be generated and the locking pin 43 and the slot 53 may be damaged, due to the collision between the locking pin 43 and the slot 53.

However, the eccentric unit 40 according to the present invention is provided with the upper brake unit 80, thus preventing the upper eccentric bush 51 from slipping.

As illustrated in FIG. 5, when the upper roller 37 comes into contact with the upper vane 61, some of the gas refrigerant returns to the upper compression chamber 31 through the upper outlet port 65 and is expanded again, thus generating a force $F_s$. The force $F_s$ acts on the upper eccentric bush 51 in the rotating direction of the rotating shaft 21 which is the first direction, thus the upper eccentric bush 51 slips over the upper eccentric cam 41. However, since the upper brake ball 83 (see, FIG. 3) comes into close contact with the upper brake hole 82 by the centrifugal force and the oil pressure, the upper eccentric cam 41 and the upper eccentric bush 51 are rotated while being restrained by each other. Thus, a resistance force $F_r$ to prevent the slippage of the upper eccentric bush 51 is generated by the upper brake ball 83, thus maximally preventing the slippage of the upper eccentric bush 51. Although there may occur the slippage of the upper eccentric bush 51, it is negligible, thus ensuring a smooth operation of the upper roller 37.

When the rotating shaft 21 stops rotating, the upper brake ball 83 is not affected by the centrifugal force and the oil pressure. At this time, the upper brake ball 83 is moved into the upper pocket 81. In such a state, when the rotating shaft 21 is rotated in the second direction, the locking pin 43 contacts the second end 53*b* of the slot 53, thus the compression operation is executed in the lower compression chamber 32. The compression operation executed in the lower compression chamber 32 will be described in the following.

Figure 7:
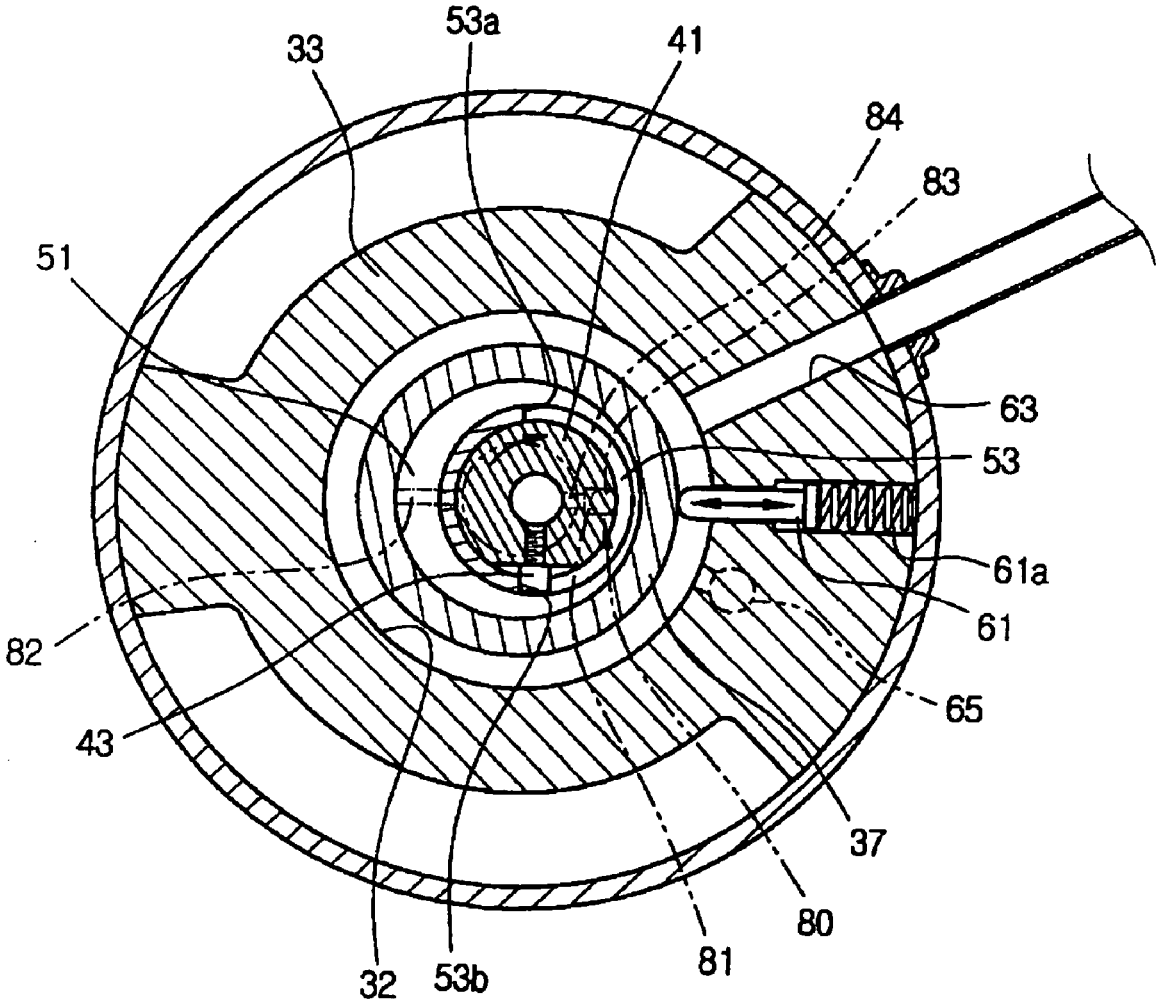
FIG. 7 is a sectional view, corresponding to FIG. 6, which shows the upper compression chamber where the idle operation is executed by the eccentric unit of FIG. 2, when the rotating shaft is rotated in the second direction.

FIG. 6 is a sectional view showing the lower compression chamber 32 where the compression operation is executed without slippage by the eccentric unit 40 of FIG. 2, when the rotating shaft 21 is rotated in a second direction. FIG. 7 is a sectional view, corresponding to FIG. 6, which shows the upper compression chamber 31 where the idle operation is executed by the eccentric unit 40 of FIG. 2, when the rotating shaft 21 is rotated in the second direction.

Figure 8:
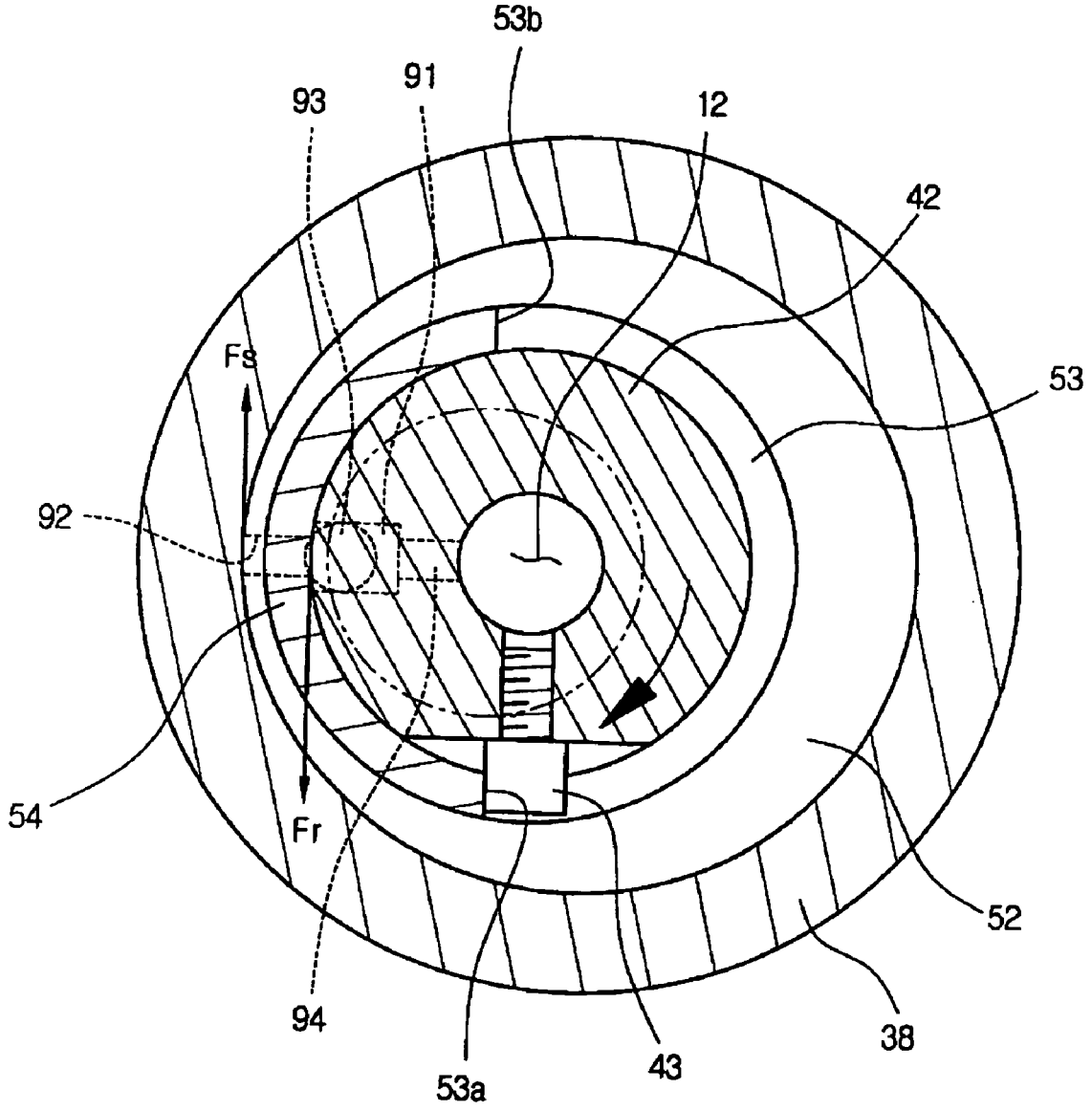
FIG. 8 is a sectional view showing a lower eccentric bush when the rotating shaft is rotated in the second direction, in which the lower eccentric bush does not slip at a predetermined position by the eccentric unit of FIG. 2.

FIG. 8 is a sectional view showing the lower eccentric bush 52 when the rotating shaft 21 is rotated in the second direction, in which the lower eccentric bush 52 does not slip at a predetermined position by the eccentric unit 40 of FIG. 2.

As illustrated in FIG. 6, when the rotating shaft 21 is rotated in the second direction which is clockwise in FIG. 6, the compressor is operated oppositely to the operation shown in FIGS. 3 and 4, thus causing the compression operation to be executed in only the lower compression chamber 32.

That is, while the rotating shaft 21 is rotated in the second direction, the locking pin 43 projected from the rotating shaft 21 comes into contact with the second end 53*b* of the slot 53, thus causing the lower and upper eccentric bushes 52 and 51 to be rotated in the second direction.

In this case, the maximum eccentric part of the lower eccentric cam 42 contacts the maximum eccentric part of the lower eccentric bush 52, thus the lower eccentric bush 52 is rotated while being maximally eccentric from the central axis C1—C1 of the rotating shaft 21. Therefore, the lower roller 38 is rotated while being in contact with the inner surface of the housing 33 which defines the lower compression chamber 32, thus executing the compression operation.

As illustrated in FIG. 7, the maximum eccentric part of the upper eccentric cam 41 contacts with the minimum eccentric part of the upper eccentric bush 51. In this case, the upper eccentric bush 51 is rotated while being concentric with the central axis C1—C1 of the rotating shaft 21. Thus, the upper roller 37 is rotated while being spaced apart from the inner surface of the housing 33, which defines the upper compression chamber 31, by a predetermined interval, thus the compression operation is not executed.

Therefore, the gas refrigerant flowing to the lower compression chamber 32 through the lower inlet port 64 is compressed by the lower roller 38 in the lower compression chamber 32 having a smaller capacity, and subsequently is discharged from the lower compression chamber 32 through the lower outlet port 66. On the other hand, the compression operation is not executed in the upper compression chamber 31 having a larger capacity. Therefore, the rotary compressor is operated in a smaller capacity compression mode.

As shown in FIG. 6, when the lower roller 38 comes into contact with the lower vane 62, the operation of compressing the gas refrigerant is completed and an operation of drawing the gas refrigerant is started. At this time, some of the compressed gas, which was not discharged from the lower compression chamber 32 through the lower outlet port 66, returns to the lower compression chamber 32 and is expanded again, thus applying a pressure to the lower roller 38 and the lower eccentric bush 52 in a rotating direction of the rotating shaft 21. At this time, the lower eccentric bush 52 is rotated faster than the rotating shaft 21, thus causing the lower eccentric bush 52 to slip over the lower eccentric cam 42.

When the rotating shaft 21 is further rotated in such a state, the locking pin 43 collides with the second end 53*b* of the slot 53 to make the lower eccentric bush 52 be rotated at a same speed as that of the rotating shaft 21. At this time, noise may be generated and the locking pin 43 and the slot 53 may be damaged, due to the collision between the locking pin 43 and the slot 53.

However, the lower eccentric bush 52 is restrained by the lower brake unit 90 in a same manner as the upper eccentric bush 51 is restrained by the upper brake unit 80 when the rotating shaft 21 is rotated in the first direction, thus preventing the slippage and the collision.

That is, when the lower roller 38 comes into contact with the lower vane 62, some of the gas refrigerant returns to the lower compression chamber 32 through the lower outlet port 66 and is expanded again, thus generating a force $F_s$. The force $F_s$ acts on the lower eccentric bush 52 in the rotating direction of the rotating shaft 21 which is the second direction, thus the lower eccentric bush 52 slips. However, as illustrated in FIG. 8, since the lower brake ball 93 comes into close contact with the lower brake hole 92 by the centrifugal force and the oil pressure, the lower eccentric cam 42 and the lower eccentric bush 52 are rotated while being restrained by each other. Thus, a resistance force $F_r$ to prevent the slippage of the lower eccentric bush 52 is generated by the lower brake ball 93, therefore maximally preventing the lower eccentric bush 52 from slipping. Moreover, although slippage of the lower eccentric bush 52 may occur, such slippage is negligible, thus ensuring a smooth operation of the lower roller 38.

When the rotating shaft 21 stops rotating, the lower brake ball 93 is not affected by the centrifugal force and the oil pressure. At this time, the lower brake ball 93 is moved into the lower pocket 91. In such a state, when the rotating shaft 21 is rotated in the first direction, the locking pin 43 contacts the first end 53*a* of the slot 53, thus the compression operation is executed in the upper compression chamber 31.

As apparent from the above description, the present invention provides a variable capacity rotary compressor, which is designed to execute a compression operation in either of upper and lower compression chambers having different interior capacities by an eccentric unit which is rotated in the first or second direction, thus varying a compression capacity of the compressor as desired. While described in terms of balls 81, 91, it is understood that other shapes could be used in the brake units 80, 90 so long as the shape prevents slipping.

Further, the present invention provides a variable capacity rotary compressor, which has an upper brake unit between an upper eccentric cam and an upper eccentric bush, and has a lower brake unit between a lower eccentric cam and a lower eccentric bush, thus preventing the upper or lower eccentric bush from slipping due to variance of pressure in an upper or lower compression chamber when an eccentric unit is rotated in the first or second direction, therefore allowing the upper and lower eccentric bushes to be smoothly rotated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

an upper compression chamber having a first interior capacity;

a lower compression chamber having a second interior capacity other than the first interior capacitor;

a rotating shaft passing through the upper and lower compression chambers;

upper and lower eccentric cams provided on the rotating shaft;

upper and lower eccentric bushes fitted over the upper and lower eccentric cams, respectively;

a slot provided at a predetermined position between the upper and lower eccentric bushes;

a locking pin to cooperate with the slot and selectively change a position of one of the upper and lower eccentric bushes to a maximum eccentric position; and upper and lower brake units to prevent the upper and lower eccentric bushes from slipping over the rotating shaft, respectively.

2. The rotary compressor according to claim 1, wherein:

the locking pin projects from the rotating shaft between the upper and lower eccentric cams, the slot is between the upper and lower eccentric bushes to engage the locking pin, the upper brake unit is provided between the upper eccentric cam and the upper eccentric bush, and the lower brake unit is between the lower eccentric cam and the lower eccentric bush.

3. The rotary compressor according to claim 2, wherein the upper brake unit comprises:

an upper pocket formed on an outer surface of the upper eccentric cam;

an upper brake ball movably set in the upper pocket; and an upper brake hole formed on an inner surface of the upper eccentric bush to have a smaller diameter than the upper brake ball, so that, when the locking pin contacts a first end of the slot, the upper pocket is aligned with the upper brake hole and the upper brake ball is partially inserted into the upper brake hole due to a centrifugal force when the rotating shaft rotates.

4. The rotary compressor according to claim 3, wherein the slot has a length to allow an angle between a first line extending from the first end of the slot to a center of the rotating shaft and a second line extending from a second end of the slot to the center of the rotating shaft that is 180° relative to each other, and when the locking pin contacts the first end of the slot, the upper pocket and the upper brake hole are positioned to be aligned with each other.

5. The rotary compressor according to claim 3, further comprising:

an oil passage axially provided along the rotating shaft; and an upper connecting passage having a smaller diameter than the upper brake ball, wherein the upper pocket communicates with the oil passage via the upper connecting passage so as to feed oil from the oil passage through the upper connecting passage to the upper pocket and allowing an oil pressure to act on the upper brake ball in a radial direction of the rotating shaft.

6. The rotary compressor according to claim 5, wherein the upper brake hole is formed through the upper eccentric bush in a radial direction to allow the oil to flow to an outside of the upper eccentric bush after passing through the oil passage and the upper brake hole.

7. The rotary compressor according to claim 2, wherein the lower brake unit comprises:

a lower pocket formed on an outer surface of the lower eccentric cam;

a lower brake ball movably set in the lower pocket; and a lower brake hole formed on an inner surface of the lower eccentric bush to have a smaller diameter than the lower brake ball, so that, when the locking pin contacts a second end of the slot, the lower pocket is aligned with the lower brake hole and the lower brake ball is partially inserted into the lower brake hole due to a centrifugal force when the rotating shaft rotates.

8. The rotary compressor according to claim 7, wherein the slot has a length to allow an angle between a first line extending from a first end of the slot to a center of the rotating shaft and a second line extending from the second end of the slot to the center of the rotating shaft, that is extend 180° relative to each other, and when the locking pin contacts the second end of the slot, the lower pocket and the lower brake hole are positioned to be aligned with each other.

9. The rotary compressor according to claim 7, further comprising:

an oil passage axially provided along the rotating shaft; and a lower connecting passage having a smaller diameter than the upper brake ball, wherein the lower pocket communicates with the oil passage via the lower connecting passage so as to feed oil from the oil passage through the lower connecting passage to the lower pocket and allowing an oil pressure to act on the lower brake ball in a radial direction of the rotating shaft.

10. The rotary compressor according to claim 9, wherein the lower brake hole is formed through the lower eccentric bush in a radial direction to allow the oil to flow to an outside of the lower eccentric bush after passing through the oil passage and the lower brake hole.

11. A rotary compressor, comprising:

a shaft rotating in first and second directions;

a first compression chambers having a first capacity, through which the shaft extends, in which a first compressing operation is selectively carried out;

a second compression chamber having a second capacity through which the shaft extends, in which a second compressing operation is selectively carried out;

first and second eccentric units placed in each of the first and second compression chambers, respectively, to execute the compressing operation;

a slot, having first and second ends, provided at a predetermined position between the first and second eccentric units;

a locking pin to selectively engage the first and second ends of the slot when the shaft rotates in the first and second directions, respectively, to carry out one of the first and second compressing operations, respectively; and first and second brake units to prevent a slipping incident in the compression chamber in which the compressing operation is carried out.

12. The rotary compressor according to claim 11, wherein first and second rollers are placed in the first and second compression chambers, respectively, to be fitted over the eccentric unit in the first and second compression chambers, respectively.

13. The rotary compressor according to claim 12, wherein first inlet and outlet ports communicate with the first compression chamber, second inlet and outlet ports communicate with the second compression chamber, a first vane is provided between the first inlet and outlet ports, and a second vane is provided between the second inlet and outlet ports.

14. The rotary compressor according to claim 11, wherein the first and second eccentric units comprise:

first and second eccentric cams on the shaft in the first and second compression chambers, respectively;

first and second eccentric bushes fitted over the first and second eccentric cams respectively.

15. The rotary compressor according to claim 14, wherein the locking pin is provided between the first and second eccentric cams.

16. The rotary compressor according to claim 15, wherein a threaded hole is formed on the shaft between the first and second eccentric cams to be at substantially 90° with maximum eccentric parts of the first and second eccentric cams.

17. The rotary compressor according to claim 16, wherein when the shaft is rotated in one of the first and second direction, the first and second eccentric bushes selectively rotate when the locking pin comes into contact with a corresponding one of the first and second ends of the slot.

18. The rotary compressor according to claim 17, wherein a maximum eccentric part of the first eccentric bush is opposite a maximum eccentric part of the second eccentric bush.

19. The rotary compressor according to claim 18, wherein an angle between a line extending from the first end of the slot to a center of the shaft and a line extending from the second end of the slot to the center of the rotating shaft is substantially 180°.

20. The rotary compressor according to claim 14, wherein the first brake unit is between the first eccentric cam and the first eccentric bush, while the second brake unit is provided between the second eccentric cam and the second eccentric bush.

21. The rotary compressor according to claim 11, wherein the first brake unit comprises:

a first pocket bored on an outer surface of the first eccentric cam to have a predetermined diameter;

a first brake hole bored on an inner surface of the first eccentric bush to have a predetermined diameter; and a first brake unit set in the first pocket, wherein the first brake ball has a slightly smaller diameter than the first pocket while having a slightly larger diameter than the first brake hole.

22. The rotary compressor according to claim 21, wherein when a centrifugal force on the first brake unit is generated, the first brake unit is partially inserted into the first brake hole, thereby preventing the first eccentric bush from slipping over the first eccentric cam.

23. The rotary compressor according to claim 22, further comprising an oil passage axially formed along the shaft with which the first pocket communicates via a first connecting passage which connects the first pocket to the oil passage.

24. The rotary compressor according to claim 23, wherein when the locking pin contacts the first end of the slot, and the first eccentric cam and the first eccentric bush are positioned to be maximally eccentric from the rotating shaft, the first pocket and the first brake hole are positioned in a row.

25. The rotary compressor according to claim 24, wherein when the shaft is rotated in the first direction, the first pocket is positioned leading the locking pin while being angularly spaced apart from the locking pin at an angle of 90°, and the first brake hole is positioned leading the first end of the slot while being angularly spaced apart from the first end of the slot at an angle of 90°, such that the locking pin contacts the first end of the slot, and the shaft is rotated along with the first and second eccentric bushes in the first direction, the first pocket is aligned with the first brake hole in a row.

26. The rotary compressor according to claim 11, wherein the second brake unit comprises:

a second pocket bored on an outer surface of the second eccentric cam to have a predetermined diameter;

a second brake hole bored on an inner surface of the second eccentric bush to have a predetermined diameter; and a second brake unit set in the second pocket, wherein the second brake unit has a slightly smaller diameter than the second pocket while having a slightly larger diameter than the second brake hole.

27. The rotary compressor according to claim 26, wherein when a centrifugal force on the second brake unit is generated, the second brake unit is partially inserted into the second brake hole, thereby preventing the second eccentric bush from slipping over the second eccentric cam.

28. The rotary compressor according to claim 27, further comprising an oil passage axially formed along the shaft with which the second pocket communicates via a second connecting passage which connects the second pocket to the oil passage.

29. The rotary compressor according to claim 28, wherein when the locking pin contacts the first end of the slot, and the second eccentric cam and the second eccentric bush are positioned to be maximally eccentric from the rotating shaft, the second pocket and the second brake hole are positioned in a row.

30. The rotary compressor according to claim 26, wherein when the shaft is rotated in the second direction, the second pocket is positioned leading the locking pin while being angularly spaced apart from the locking pin at an angle of 90°, and the second brake hole is positioned leading the first end of the slot while being angularly spaced apart from the second end of the slot at an angle of 90°, such that the locking pin contacts the second end of the slot, and the shaft is rotated along with the first and second eccentric bushes in the second direction, the second pocket is aligned with the second brake hole in a row.

31. A refrigerator comprising:

a variable speed compressor comprising:

a shaft rotating in first and second directions, a first compression chambers having a first capacity, through which the shaft extends, in which a first compressing operation is selectively carried out, a second compression chamber having a second capacity through which the shaft extends, in which a second compressing operation is selectively carried out, first and second eccentric units placed in each of the first and second compression chambers, respectively, to execute the compressing operation, a slot, having first and second ends, provided at a predetermined position between the first and second eccentric units, a locking pin to selectively engage the first and second ends of the slot when the shaft rotates in the first and second directions, respectively, to carry out one of the first and second compressing operations, respectively, and first and second brake units to prevent a slipping incident in the compression chamber in which the compressing operation is carried out.

* * * * *